United States Patent [19]

Bauer et al.

[11] 4,286,692

[45] Sep. 1, 1981

[54] HYDRAULIC CONTROL SYSTEM FOR OPERATING MULTIPLE REMOTE DEVICES WITH A MINIMUM NUMBER OF CONNECTING CONDUITS

[75] Inventors: James J. Bauer, Richland; Willard L. Chichester, Battle Creek, both of Mich.

[73] Assignee: Clark Equipment Company, Buchanan, Mich.

[21] Appl. No.: 944,829

[22] Filed: Sep. 22, 1978

[51] Int. Cl.[3] ..... B66B 9/20

[52] U.S. Cl. ..... 187/9 R; 91/518

[58] Field of Search ..... 187/9 R, 9 E; 414/620, 414/621; 91/536, 514, 517, 518; 137/355.17

[56] References Cited

U.S. PATENT DOCUMENTS

| | | | |
|---|---|---|---|
| 3,692,198 | 9/1972 | Lake | 414/621 |
| 3,705,631 | 12/1972 | Seaberg | 91/536 |
| 3,976,097 | 8/1976 | Brakel | 91/518 |
| 3,982,469 | 9/1976 | Blanchetta | 91/518 |
| 4,161,256 | 7/1979 | Seaberg | 414/621 |

*Primary Examiner*—Robert J. Spar
*Assistant Examiner*—Kenneth Noland
*Attorney, Agent, or Firm*—J. C. Wiessler

[57] ABSTRACT

A hydraulic control circuit especially for use with multi-function hydraulic devices, such as for industrial lift truck attachments, in which a combination of valves are adapted to operate two or more hydraulic systems, the valve system being designed such that a minimum number of hydraulic conduits are required to connect the main hydraulic system to the hydraulic devices, as from a lift truck to an attachment supporting carriage on a lift truck upright, and no electric lines are required to be connected to switching devices between the hydraulic devices, such as to solenoid operated valves.

14 Claims, 10 Drawing Figures

HYDRAULIC CONTROL SYSTEM FOR OPERATING MULTIPLE REMOTE DEVICES WITH A MINIMUM NUMBER OF CONNECTING CONDUITS

BACKGROUND OF THE INVENTION

Multi-function hydraulically operated devices which operate at a location which may be movable in one or more directions in relation to the connected hydraulic system requires connecting hydraulic conduits to be movably mounted so that the terminus of hydraulic conduits are continuously connected to the moving device. Examples of such remote devices include multi-function attachments mounted for elevation on telescopic lift truck uprights, devices mounted for operation from the end of telescopic crane or boom mechanisms, and others.

This background and our invention will be described with particular reference to hydraulic control systems for lift truck attachments, but it will be understood that our invention has much wider application as indicated by the title hereof.

As is well-known in the exemplary field of lift trucks, a large variety of attachments have been designed for support by a carriage, conventionally known as a fork carriage, which is elevatable in a telescopic upright for performing various functions for which the attachment may be designed at any selected elevation of the carriage and upright. Such attachments may, for example, be of types known as side shifting clamps, rotating roll clamps, side loaders, and others. Thus, it is required, depending upon the number of functions or operations which the attachment is designed to perform, that a plurality of flexible hydraulic conduits plus, in some instances, electric lines which connect with switching solenoid valves on the lift carriage, for example, be connected from the truck hydraulic system to the attachment by reeving the conduits and lines in the upright, or adjacent to it, for vertical movement with the carriage.

Various means have been devised heretofore for improving the handling and routing of hoses and electric lines in such applications, examples of which are described and claimed in the dual hose reel U.S. Pat. No. 3,709,252, and the internal upright reeving of hydraulic conduits and electric lines as disclosed in U.S. Pat. Nos. 3,462,028 and 3,491,905, all of common assignee. As is well known to persons skilled in the art, disadvantages multiply with the addition of attachment fucntions which necessitate the addition of more hydraulic conduits and/or electric lines reeved on the upright to travel with the lift carriage. Such disadvantages include interference with operator visibility through the upright, greater probability of rupture or breakage of multiple hydraulic and electric lines, relatively high cost, both initial and in maintenance, and others. One design to minimize the number of such conduits, which in operating some lift truck attachments have heretofore required as many as eight upright reeved hoses, is exemplified by U.S. Pat. No. 3,692,198, also of common assignee. It dislcoses a structure for reducing the required number of upright reeved conduits to as few as three in relation to a side shifting clamp attachment.

We have devised a hydraulic system for use in such lift truck applications, for example, which is capable of operating an attachment having a plurality of operating functions with as few as two hydraulic conduits reeved in the upright, and with no electric lines reeved therein for connection to carriage mounted solenoid valves as previously used in certain attachment applications.

SUMMARY

A hydraulic control system for operating multi-function remote devices by means of as few as two hydraulic conduits connected from the main hydraulic system to the remote device, the control system including a combination of valve means cooperating to operate under selected conditions any one of a plurality of hydraulically operated functions of the remote device.

It is therefore a principal object of the invention to provide a hydraulic system for minimizing the number of hydraulic conduits connecting it to a remote multi-function device.

Other objects and advantages will become apparent from the following description and accompanying drawings.

DETAILED DESCRIPTION

Figure 1:
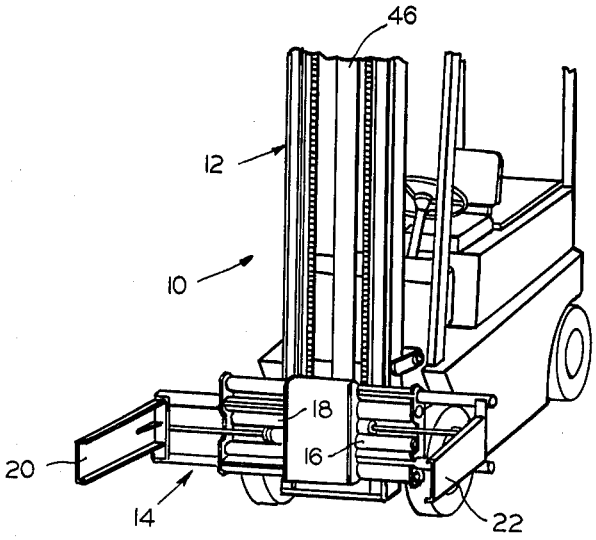
FIG. 1 is a perspective partial view of a lift truck having an exemplary attachment mounted on the upright.

Numeral 10 indicates an industrial lift truck of known configuration having located at the front end thereof a telescopic upright assembly 12 on which is mounted for elevation a side shifting clamp attachment 14 having a pair of hydraulic cylinder actuators 16 and 18 connected to opposed and transversely movable clamp arms 20 and 22. The hydraulic system of the truck is connected to the actuators 16 and 18 in such a manner that clamp arms 20 and 22 may, at the operator's selection, be actuated either toward or away from each other to clamp or unclamp a load located therebetween, or may be actuated in the same direction to shift a clamped load sidewise in either direction transversely of the center line of the truck.

The attachment 14 is merely illustrative of one of many types of multi-function hydraulic attachments for lift trucks or multi-function hydraulic devices for use with other types of vehicles or for other purposes. The attachment 14 is representative of a two-function attachment, viz., for side shifting and clamping actions, whereas, for example, an attachment known as a side shifting rotating clamp is representative of a three-function attachment, viz., side shifting, clamping and rotating. In the latter attachment, for example, current practice requires at least four hydraulic conduits and one electric conduit reeved on the upright to enable the attachment to perform its available functions. Our invention can be implemented, for example, to operate such a threefunction attachment with as few as two hydraulic conduits and no electric lines reeved on the upright, as will become apparent as the description proceeds. It will also become apparent that our invention may be implemented to perform any number of remote hydraulic actuated functions as desired without requiring electric lines or more than two hydraulic conduits to be reeved on an upright, telescopic boom, or whatever structure may be utilized to support hydraulic conduits which connect a hydraulic control system to a remote hydraulic operated device.

FIGS. 2–5 illustrate in various modes of operation the basics of our invention in a two-function application, wherein a pair of opposed movement cylinders is represented at 30 and 32 and a shift cylinder is represented at 34.

The main hydraulic system is conventional. It comprises a supply pump 36 connected to a reservoir 38 adapted to recirculate under any over-pressure condition through a relief valve 40 by way of conduits 42 and 44. A single-acting lift cylinder assembly 46 for operating the upright 12 and attachment 14 in elevation is connected to a valve 50 by a conduit 52, and a pair of double-acting upright tilt cylinders 54 for tilting upright 12 about the bottom end thereof is connected to a directional control valve 56 by conduits 58, 60 and branch conduits 62, 64. Valves 50 and 56 are operator controlled as by manual levers 66 and 68, the valves being of the known open-center type shown in FIG. 2 in neutral or "hold" positions wherein the discharge of the pump circulates back to reservoir by way of conduits 42, 48, the center or neutral sections of valves 50 and 56, the open center position as shown of an auxiliary directional control valve 76 and of an auxiliary system selector valve 78, and conduits 70, 72, 74 and 44.

Valve 50 is actuated down, as shown, to pressurize and elevate lift cylinder 46 and upright 12 by way of a valve section 80 which connects the lift cylinder to the pump via conduits 42, a check valve 82, and conduits 84 and 52. Conversely, valve 50 may be actuated to connect lift cylinder 46 to the reservoir by way of conduits 52 and 44, and valve section 86. Similarly, valve 56 may be actuated to operate cylinders 54 to tilt the upright forwardly by connecting the discharge of the pump to the head ends of the cylinders by way of conduits 42, 90 and 92, a check valve 94, valve section 96, and conduits 58 and 62. The upright is tilted rearwardly by connecting the pump discharge to the rod ends of cylinders 54 by the same circuit upstream of the valve, and valve section 98 and conduits 60 and 64, the opposite ends of cylinders 54 in each instance being connected to reservoir by way of the respective valve section 96 or 98 and conduits 100, 74 and 44.

Figure 9:
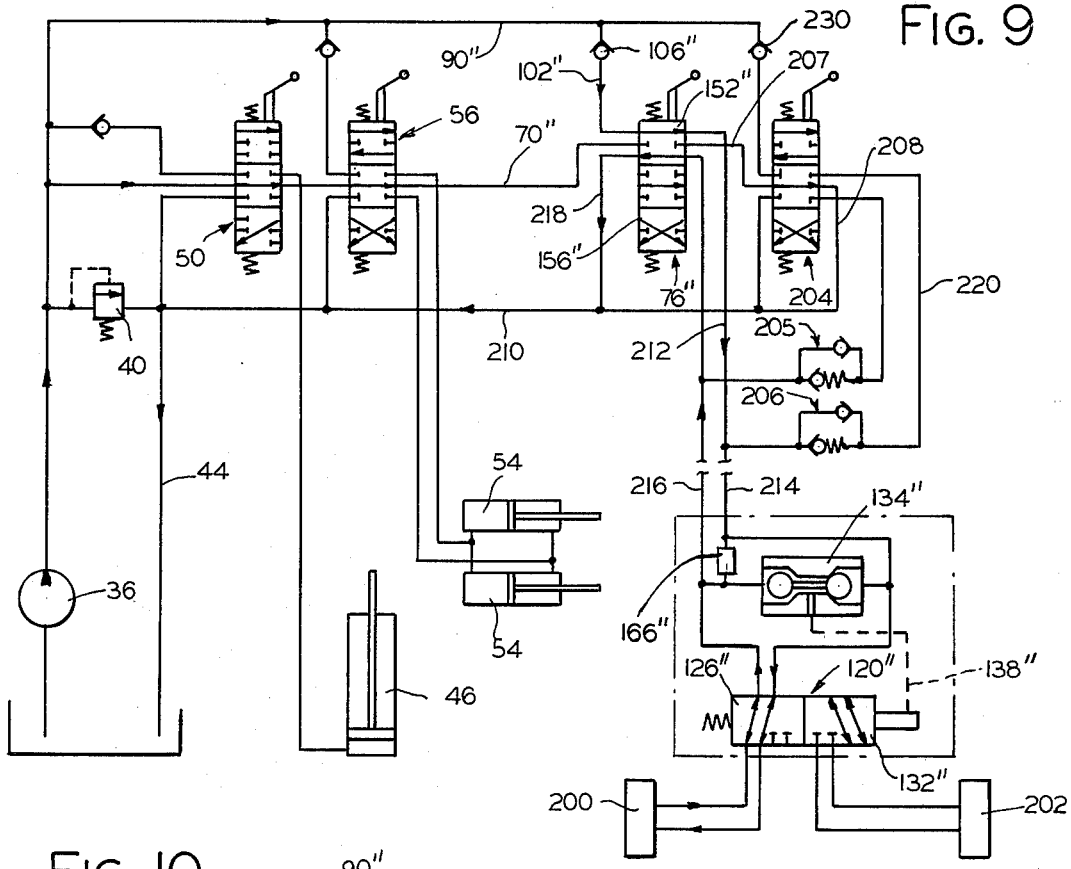
FIGS. 9 and 10 illustrate another embodiment of our invention for operating in two different modes a two-function attachment.

The hydraulic system as described thus far is conventional, except for auxiliary selector valve 78 and its combination with auxiliary valve 76, so that in none of the remaining figures excepting only FIG. 9 have the lift and tilt actuating and control means been shown, it being understood that at least in respect of the use of the invention with a lift truck that selector valves 50 and 56 and associated circuitry as described above for controlling the lift and tilt cylinders, or the equivalent thereof, are included in the system.

The auxiliary device or attachment which is represented by cylinders 30, 32 and 34 in FIGS. 2–5 is shown in a non-operative or operative "hold" condition in which valve 76 is in an open center position wherein it connects line 70 to the reservoir, the remaining four ports of the valve center section being blocked ports connected to a pair of conduits 102, 104 and a check valve 106 on one side, and to conduits 108 and 110 on the other side of the valve. Control valves 76 and 78 are operator controlled by levers 112 and 114 for a purpose to be described and are located, along with control valves 50 and 56, conveniently at the operator's station on the truck, conduits 108 and 110 being the only operative connecting means as shown adapted to be reeved on upright 12 by any conventional means, not shown, for operating the independent twin functions of the attachment device in the embodiment as illustrated. A spring actuated, pilot operated valve 120 is located in the control circuit between conduits 108, 110 and a first pair of conduits 122 and 124 which connect valve section 126 to cylinder 34 under certain conditions, and a second pair of conduits 128, 130 which are adapted under other conditions to connect cylinders 30 and 32 to conduits 108 and 110 by way of valve section 132. A shuttle valve 134 is connected between conduits 108 and 110; it has a center pilot port 136 which is connected to valve 120 by a pilot conduit 138 to actuate valve 120 under certain conditions so as to disconnect cylinder 34 and connect cylinders 30 and 32 to conduits 108 and 110. The shuttle valve includes a pair of spaced and opposed ball check valves 140 and 142, one of which has a stem 144 secured thereto which projects through a connecting channel 146 so that depending upon which of conduits 108 or 110 contains the higher pressure fluid is determined which of the ball checks is actuated to seat which in turn causes the opposite ball check to unseat by the action of stem 144 Fluid pressure in the low pressure conduit flows through the unseated ball check into a pilot operating chamber of valve 120 by way of channel 146, port 136 and pilot conduit 138, valve 120 being normally maintained in the position shown in FIGS. 2–4 by a spring 150.

The basic circuit structure described above is preferred in respect of locating shuttle valve 134 on the attachment or other remote device so as to require two hydraulic conduits only, viz., 108 and 110, to be reeved on the upright, although the same functional result would be achieved by locating the shuttle valve on the truck which would then necessitate the additional reeving on the upright of pilot conduit 138. The use of three such conduits is clearly within the scope of the invention, although, of course, the use of two conduits only is preferred as described in respect of the circuit as shown.

Figure 2:
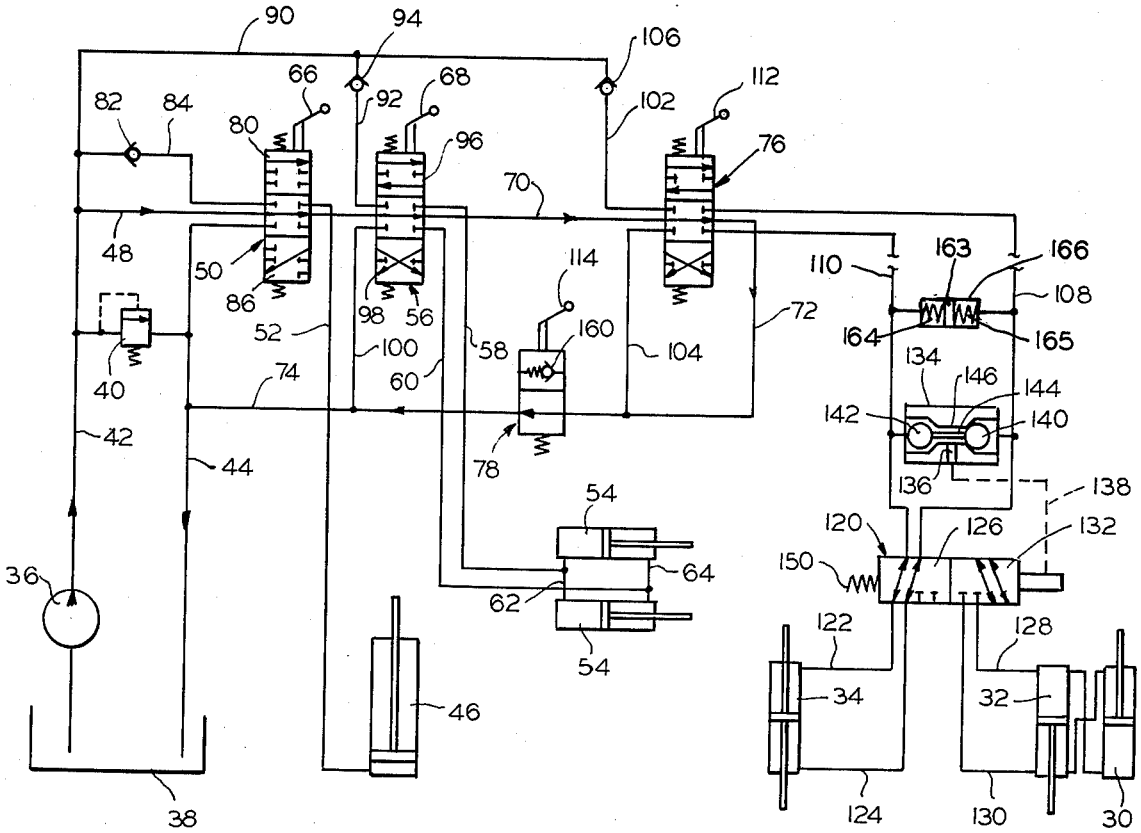
FIG. 2 is a schematic view of the main hydraulic system of the truck connected to a multi-function remote device which illustrates a preferred embodiment of our invention, the system being illustrated in a neutral condition and combined with a two function attachment.
Figure 3:
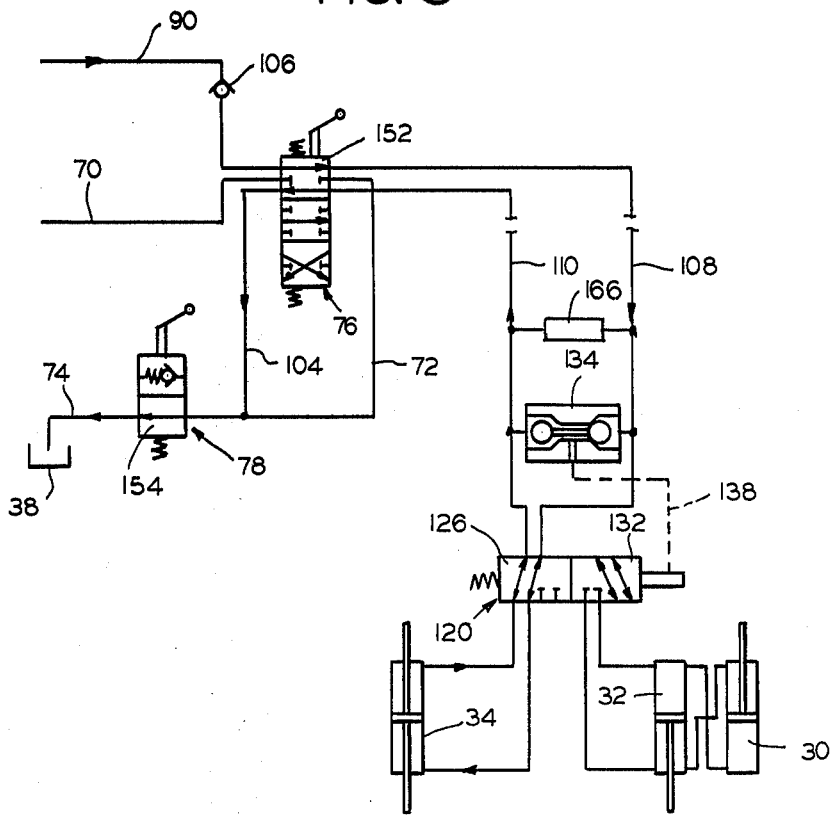
FIGS. 3–5 each shows a portion of the FIG. 2 system in a different condition of operation.

FIG. 3 is the same as FIG. 2 except that valve 76 is actuated to operate cylinder 34 in the direction illustrated by the arrowed conduits wherein pressure fluid is directed by way of check valve 106 and a valve section 152 to cylinder 34 through section 126 of valve 120, the shuttle valve 134 being actuated leftwardly by pump discharge pressure in conduit 108 thereby connecting pilot conduit 138 to valve 120. The pilor pressure is at reservoir pressure, being connected thereto by way of conduits 110, 104 and 74 through an open ported section 154 of system selector valve 78, which in its illustrated position selects with valve section 152 the described operation of cylinder 34, during which cylinders 30 and 32 are maintained in a previously selected condition, being deadported at valve section 132.

Figure 4:
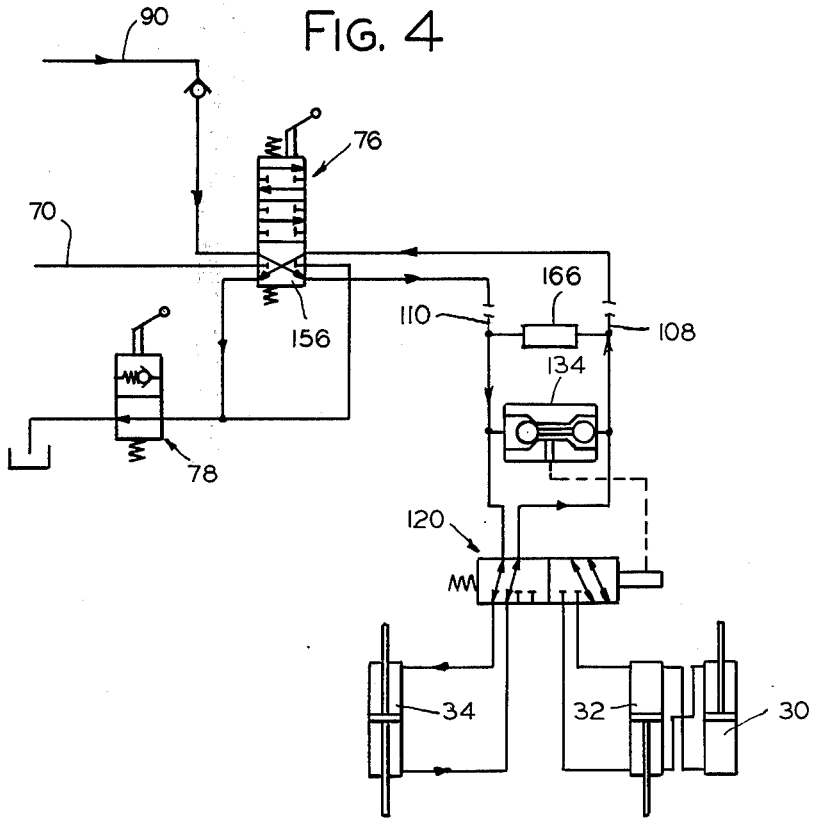

FIG. 4 illustrates a mere reversal of the condition shown in FIG. 3 wherein selector valve 76 is actuated to activate a valve section 156 which reverses the direction of flow in conduits 108 and 110 causing shuttle valve 134 to actuate rightwardly with no effect on the position of functions selector valve 120, valve 78 being in the same position as in FIG. 3, so that the sole functional difference in FIG. 4 is the reversal of direction of operation of cylinder 34.

Figure 5:
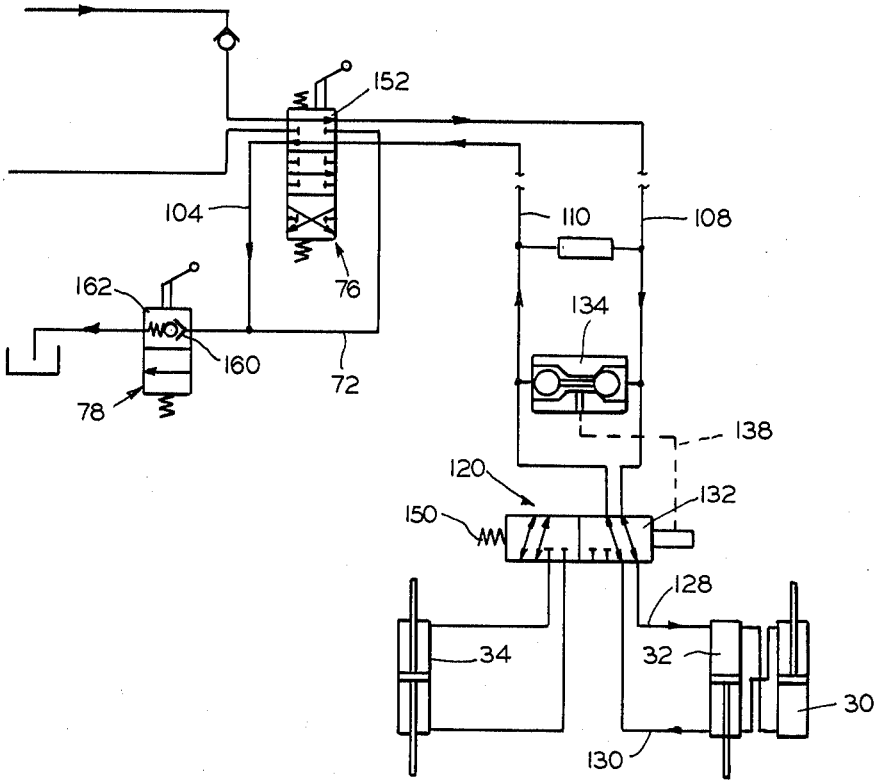

FIG. 5 illustrates the system conditioned to actuate cylinders 30 and 32, cylinder 34 being maintained in a preselected position. Valve 76 is shown in the same operating position as in FIG. 3, but valve 78 has been actuated by the operator to the second operative position thereof wherein a check valve 160 in a valve section 162 is operative in conduit 72. Assume that check valve 160 is designed to open at 200 psi. When valve 78 is actuated from the FIG. 3 position to the FIG. 5 position with valve 76 positioned as shown, pressure fluid in conduits 110, 104 and 72 increases from atmospheric to 200 psi which is maintained by check valve 160. The higher pump discharge pressure in conduit 108 maintains shuttle valve 134 in the position of FIGS. 3 and 5 so that the conduit 110 pressure causes valve 120 to actuate via pilot line 138 against the spring 150 to activate valve section 132 in respect of cylinders 30 and 32, at the same time causing cylinder 34 to hold its then existent position. Actuation of valve 76 to operate section 156 thereof reverses the direction of operation of cylinders 30 and 32 in FIG. 5 upon the actuation of shuttle valve 134 to the right, the same as in FIG. 4.

Referring again to FIG. 2, it will be noted that a free floating piston head 163 is mounted in a small hydraulic cylinder 166 between a pair of equal and opposed springs 164 and 165, the cylinder being connected at its opposite ends to lines 108 and 110. Normally in operation the compensator piston head 163 is inoperative to perform any function and moves to one end of the cylinder or the other depending upon which of lines 108 or 110 is pressurized.

In a particular condition of operation, however, which may occur from time to time at one or another of cylinders 30, 32 and 34, the compensator piston is effective to provide that very small volume of pilot pressure fluid required to actuate valve 120 by way of pilot line 138. That is, under usual conditions of operation a pilot pressure impulse to actuate valve 120 is provided via the shuttle valve by an extremely small movement of the actuator cylinder or cylinders at the time of venting of the one side of an actuator piston to reservoir pressure. However, in the event an actuator piston is bottomed out at the extreme end of its stroke at at one end or the other of its cylinder, it cannot be actuated even the minute amount required to provide pilot pressure at valve 120. Under these conditions, and only under such conditions, compensator piston 163 provides the impulse to pilot line 138 to actuate valve 120 during a selected change in direction at valve 76. Of course, piston 163 is always available for that function, but is only required to perform the function in the event that an actuator piston is bottomed out. A similar compensator cylinder and connections is represented in the remaining figures.

Of course, as is understood by persons skilled in the art, any hydraulic system of the general type contemplated adjusts itself at the pressure supply pump to provide any system pressure required for any given back pressure to perform the work for which the system is designed. The assumed 200 psi generated back pressure is utilized herein solely as a means to selectively shift valve 120, and does ot affect the functional operation of the device represented by cylinders 30 and 32. This same principle or result pertains to all of the embodiments hereof and to other applications of our invention.

Figure 6:
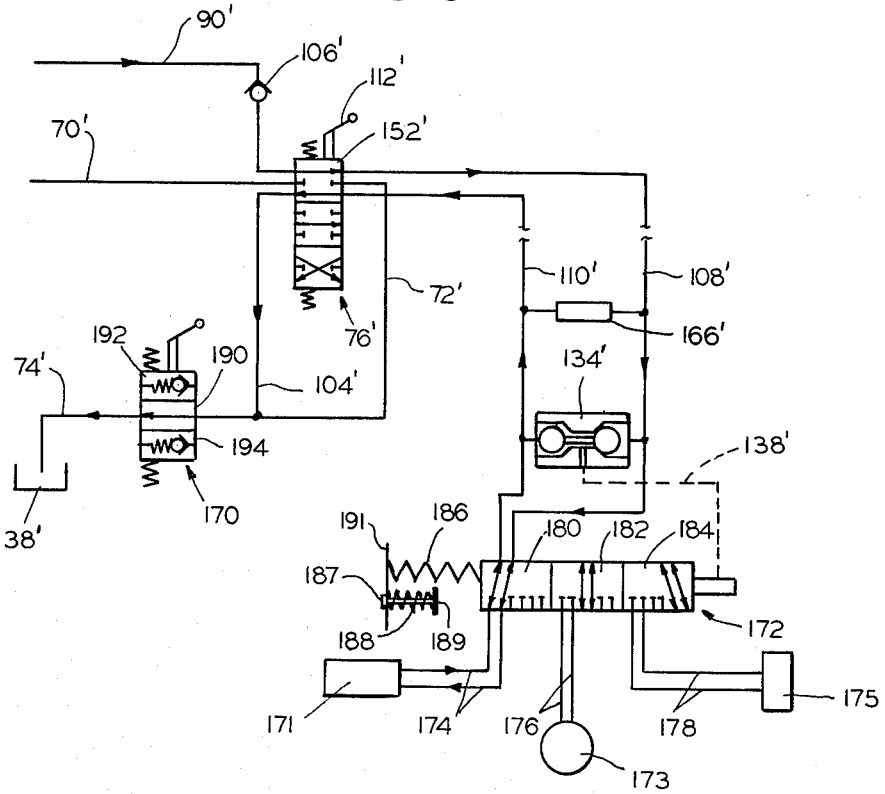
FIG. 6 illustrates a modification of the FIG. 2 system in which the relevant part of the system is shown in one operating condition and which is adapted to operate a three-function attachment.
Figure 7:
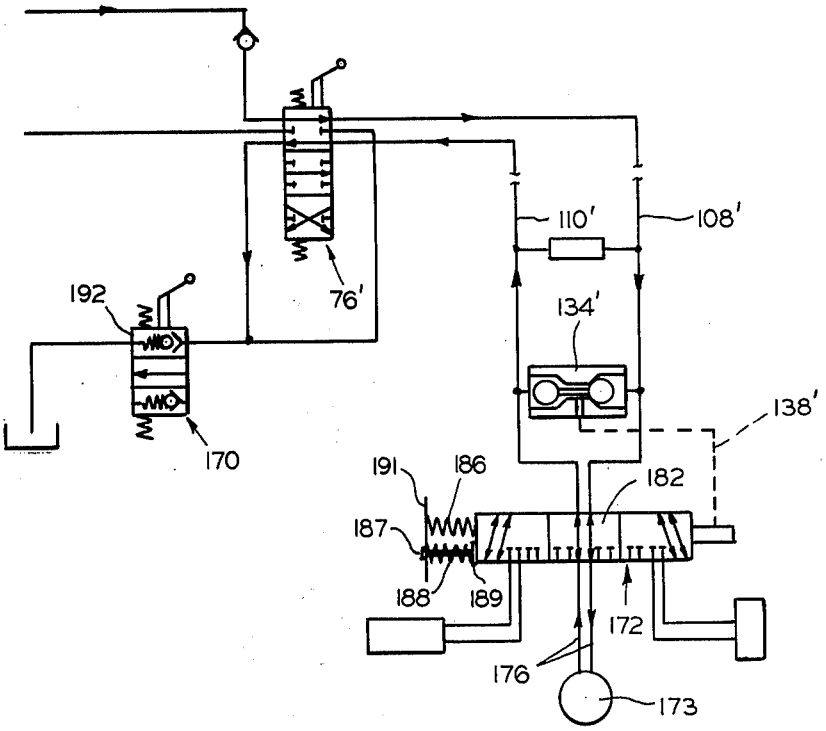
FIGS. 7 and 8 illustrate the system of FIG. 6 in different conditions of operation.
Figure 8:
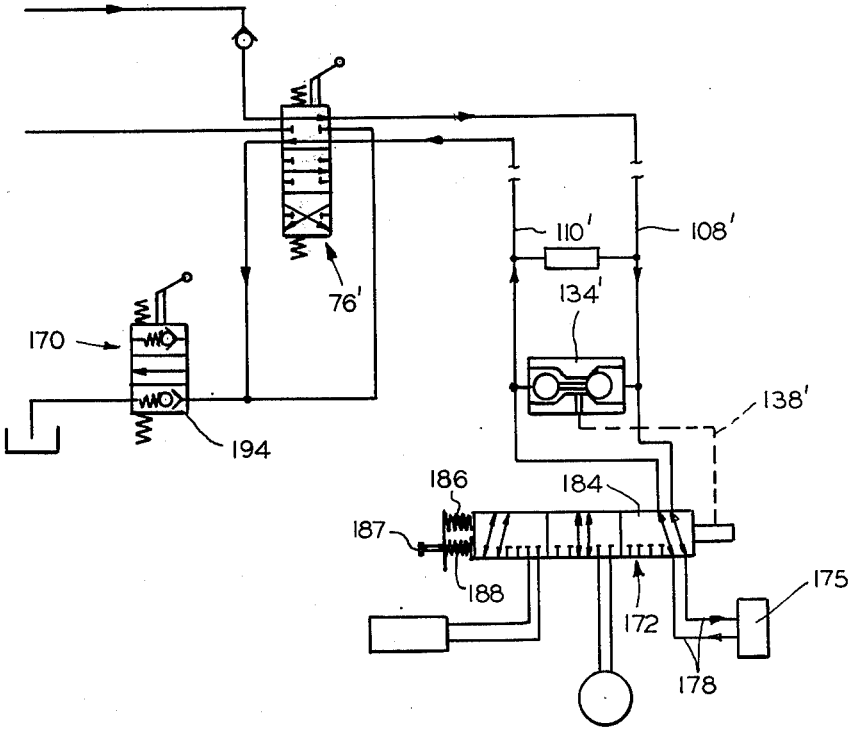

Referring to FIGS. 6, 7 and 8 there is represented the same portion of a control circuit as appears in the preceding figures modified to operate three independent system functions as compared with the two system function of FIGS. 2–5, while necessitating the connection of two hydraulic conduits only between the main control system and the attachment or other remote operating device. As explained previously three such conduits could be utilized by connecting the pilot conduit between the remote device and a relocated shuttle valve, but, of course, maximum benefits will ordinarily be obtained in the use of two such connecting conduits only.

The embodiment of FIGS. 6–8 is basically similar to the embodiment of FIGS. 2–5 and similar parts have been similarly numbered with a prime designation. The adaptation of our invention to a three-function system within the concept of the embodiment described thus far requires modification of the auxiliary system selector valve 78 and of the auxiliary system control valve 120, as shown generally at numerals 170 and 172. Three independent operative devices represented diagrammatically at 171, 173 and 175 connected respectively to pairs of conduits 174, 176 and 178, which are in turn connected as shown to certain ports in the multiported sections 180, 182 and 184 of control valve 172, are adapted to perform three independent functions in a lift truck attachment or other device, such as a side shifting rotating clamp, as referred to earlier. In order to shift valve 172 to direct working pressure fluid to selected ones of the different devices 171, 173 and 175 assume that first and second springs 186 and 188 are mounted as shown schematically, spring 186 being preloaded as in FIG. 6 at the illustrated position of valve 172 and spring 188 being preloaded and held in selected ones of a normally spaced location from valve 172 by a slidable spring retainer 187 holding a retainer plate 189 at extension as shown, both springs abutting a wall 191. For illustrative purposes let it be assumed that the valve 172 position of FIG. 6 is established by reservoir pressure in pilot line 138′ preloading spring 186 as shown, that compression of spring 186 to a position at which retainer plate 189 is initially contacted by the valve requires a 200 psi valve actuating pressure in the pilot line, and that at said pressure the valve shifts from the FIG. 6 to the FIG. 7 position. Further assume that the fluid pressure required to shift the valve from the FIG. 7 to the FIG. 8 position by compressing the combined springs 186 and 188, as shown in FIG. 8, is 400 psi. Valve 172 detents, such as known garter springs and grooves in the valve spool and body, not shown, may be used to provide required abrupt movements of valve 172 from one position to another. The required control pressures in pilot line 138′ are established by systems selector valve 170 which is comprised of valve sections 190, 192 and 194, the check valve of section 192 being designed to establish a back pressure in the auxiliary system of 200 psi and the check valve of section 194 being designed to establish said back pressure at 400 psi in the example assumed. Valve 170 is normally balanced between the end springs, as shown, being actuated downwardly to insert valve section 192 in the auxiliary circuit and upwardly to insert section 194 in said circuit, detents, not shown, being provided to hold valve 170 in selected positions. With valve section 190 in circuit, as illustrated, and directional control valve 76' in position as shown, reservoir pressure is established in conduit 110' and in pilot line 138' by shuttle valve 134', the same as in FIG. 3, so that control valve 172 is maintained in the FIG. 6 position by spring 186 thereby connecting conduits 174 to first working motor or device 171. With valve 76' remaining in position as in FIG. 7 and selector valve 170 actuated to insert valve section 192 in circuit, shuttle valve 134' remains actuated leftwardly as in FIG. 6 whereby the 200 psi control pressure in pilot line 138' actuates valve 172 to partially compress spring 186 as described above and shift the valve to the FIG. 7 position thereby connecting conduits 176 to operate the second working motor or device 173.

In FIG. 8 control valve 76' is shown still in the same position so that shuttle valve 134' remains actuated leftwardly while control valve 170 is actuated to insert valve section 194 in circuit thereby establishing a 400 psi control pressure in pilot line 138' which causes control valve 172 to now compress combined springs 186 and 188 so that at 400 psi valve 172 is actuated full left as shown to connect valve section 184 thereof with working motor or third device 175 by conduits 178.

Of course, actuation of directional valve 76' to reverse the flow in the auxiliary system effects a reversal of operation of each of the system devices 171, 173 and 175 at the different control pressure levels with shuttle valve 134' shifted to the right the same as in FIG. 4 of the previous embodiment.

Linkage means may be designed to coordinate the operation of the system selector valve 78 or 170 with the operation of directional control valve lever 112 or 112' so that the operator can control direction of operation of the remote devices by directional valve 76 or 76', and select the remote device to be actuated by selecting the position of selector valve 78 or 170, merely by manipulating a single valve lever 112 or 112', such as in the use of displaced slots in which valve 112 or 112' may operate, one for each position of valve 78 or 170. However, such synchronized selection of operation of the two valves is not a part of this invention, and so in the preceding embodiments independent levers for operating these two valves are shown.

Regardless of the number of remote auxiliary system devices for which the auxiliary system selector and auxiliary system control valves are designed, it is possible to limit the number of conduits which connect the main hydraulic system to the remote control valve controlling three or even more remote working devices to as few as two connecting conduits such as 108' and 110'. It is also again noted that in none of the embodiments are electric lines required connecting the main hydraulic system to the auxiliary or remote device control for the purpose of shifting solenoid valves, or the like, to shift operation from one remote device to another. Connecting hydraulic lines only are required.

Figure 10:
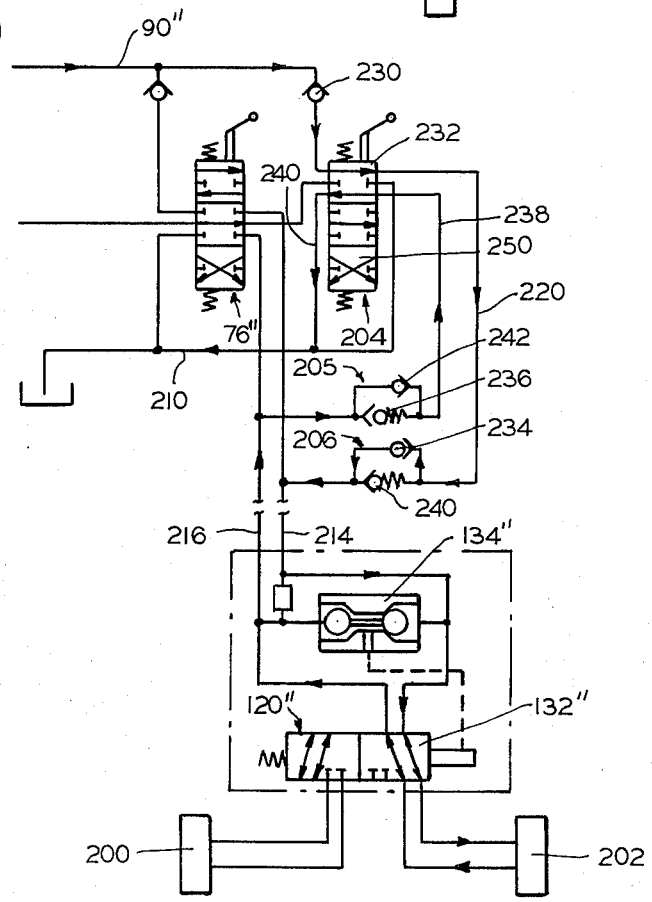

FIGS. 9 and 10 disclose a substantial modification of certain basics of the embodiments disclosed in the preceding figures. In FIG. 9 the complete hydraulic system is shown, as in FIG. 2, wherein the same parts as are shown in the conventional part of the system of FIG. 2 have been numbered the same, and parts in the auxiliary control portion of the system, as shown broken away in FIG. 10, which are similar to parts shown in the auxiliary system portion of the two system embodiment of FIGS. 2–5 have been similarly numbered with a double prime designation. The conventional portion of the system including pump 36 and lift and tilt directional control valves 50 and 56 for operating lift and tilt cylinders 46 and 54 has been described previously in connection with FIG. 2.

It will be appreciated that in principle our invention can be adapted for use with any number of system attachment or other devices merely by multiplying the control back pressure levels established by auxiliary system selector valve means and coordinating therewith the position of the auxiliary system control valve (valve 172 in FIGS. 6–8) at the different back pressure levels at each of which the latter control valve establishes fluid communication with a different system working device.

Remote devices 200 and 202 are adapted to be operated in selected sequence and direction by the operation of shuttle valve 134'' controlling the pressure signal through pilot line 138'' to auxiliary system control valve 120''. In this embodiment a pair of operator directional and remote system selector valves 76'' and 204 and pairs of check valve sets 205 and 206 are located in the auxiliary circuit upstream of valves 132'' and 134'', the said operator directional control valves and check valve sets being an alternative to the use of valves 76 and 78 of FIG. 2. When both control valves 76'' and 204 are located in neutral or opencenter positions, the auxiliary circuit flow circulates through the open-center sections of valves 76'' and 204 and back to the reservoir by way of conduits 70'', 207, 208, 210 and 44. If it is desired to operate device 200 in one direction valve 76'' is actuated downwardly while valve 204 is maintained in neutral position which deadports all valve sections of valve 204, as shown, and connects valve 76'' to pump discharge pressure and to the selected working side of device 200 by way of check valve 106'', conduit 102'', valve section 152'', conduits 212 and 214, and valve section 126''. Return flow from device 200 to the reservoir is through valve section 126', conduit 216, valve section 152'', and conduits 218, 210 and 44. Atmospheric pressure fluid is communicated as previously from conduit 216 through the shuttle valve 134'' and the pilot line so that control valve 120'' is maintained in position by the spring to operate device 200, while pump discharge fluid in conduit 212 deadports at the center valve section of valve 204 by way of check valve set 205 and conduit 220, while check valve set 205 is connected to conduit 216 and is also deadported at the said center section of valve 204. Thus, device 200 is operated in one direction as a result of the said actuation of valve 76'' and the check valves of both valve sets 205 and 206 remain seated during such operation.

A reversal of operation of device 200 is effected, of course, by actuating valve 76'' to its opposite operating valve section 156'' which reverses the flow in conduits 212 and 216 and actuates the shuttle valve 134'' to the right, thereby effecting the reversal of operation of device 200 as is apparent.

If the operator elects to operate device 202 control valve 76'' is returned to a neutral or open-center position and directional control valve 204 is actuated to operate device 202 in one direction or the other. As shown in FIG. 10 valve 204 is actuated down to connect pump discharge conduit 90'' to the one side of device 202 by way of a check valve 230, valve section 232, conduit 220, check valve 234 of valve set 206, conduit 214 and valve section 132''. The return flow from device 202 is by way of valve section 132", conduit 216, check valve 236 of valve set 205, and conduits 238, 240 and 210 to the reservoir, control valve 76" being deadported at all sections as shown.

In the check valve sets 205 and 206 checks 234 and 242 are illustrated as standard charging check valves which function to assure pressure in the respective conduits 220 and 238 when said conduits conduct system pressure fluid to device 202 and to direct control pressure flow through system pressure control checks 236 and 240 as will appear below. Control pressure checks 236 and 240 are shown spring pressure loaded and each represents an assumed 200 psi pressure loading, the same as check valve 160 of the system selector valve 78 of FIG. 2. Thus, as assumed, with the various valves positioned as in FIG. 10 the flow to device 202 occurs as above described with a 200 psi pressure generated in conduit 216 by check 236 which actuates control valve 120" to activate section 132" thereof by way of shuttle valve 134" and pilot line 138". To reverse the operation of device 202 valve 204 is actuated upwardly to engage section 250 thereof which reverses the direction of flow in the auxiliary system conduits such that the shuttle valve is actuated to the right and the exhaust pressure of device 202 is controlled at the assumed 200 psi by check valve 240 holding control valve 120" in its FIG. 10 illustrated position.

As will be appreciated from the foregoing the system of FIGS. 9 and 10 may be readily modified to adapt it to operate three, or even more, auxiliary devices by adding directional control valves the same as valves 76" and 204 and by adding a check valve circuit including check valve sets similar to 205 and 206 for each additional directional control valve, all plumbed by conduit means to actuate an additionally multiported auxiliary system control valve, such as valve 172 in FIGS. 6–8 for an auxiliary three device system. In any such system according to the embodiment of FIGS. 9 and 10 when applied, for example, to remote devices located in an attachment on the upright of a fork truck as previously described, the pair only of hydraulic conduits required to be reeved in the upright are the conduits 214 and 216 between shuttle valve 134" and check valve 236 and 240, the check valves being mounted on the truck. Again, if the shuttle valve were mounted on the truck a third line would be required to be reeved in the upright, namely the pilot line 138", but the preferred embodiment involves two such reeved hydraulic lines only, or two such hydraulic lines connecting any main hydraulic system to such remote operative devices, without the requirement for reeving or connecting remote solenoid valves, or the like, for the purpose of operating such remote hydraulic devices.

Although we have described and illustrated a few embodiments of our invention, it will be understood by those skilled in the art that modifications may be made in the structure, form and relative arrangement of parts without necessarily departing from the spirit and scope of the invention. Accordingly, it should be understood that we intend to cover by the appended claims all such modifications in both structure and application which fall within the scope of the invention.

We claim:

1. In a hydraulic system, first and second hydraulic motor means, selector valve means movable to first and second positions in response to first and second respective control pressures present in the low pressure side of the system for operatively connecting said valve means in said first position to said first hydraulic motor means and in said second position to said second hydraulic motor means, operator valve means adapted to select the operation of said first or second motor means and to establish said first or second control pressure, and shuttle valve means continuously responsive to the high pressure side of the system for continuously communicating the low pressure side thereof to said selector valve means when the system is in operation.

2. A hydraulic system as claimed in claim 1 wherein said first and second motor means, and said selector and shuttle valve means are remote from said operator valve means, and two hydraulic conduits only connected from said operator valve means to said shuttle valve means.

3. A hydraulic system as claimed in claim 1 wherein said first and second motor means and said selector valve means are remote from said operator and shuttle valve means, and three conduits only connected from said shuttle valve means to said selector valve means.

4. A hydraulic system as claimed in claim 1 wherein said operator valve means includes check valve means for establishing at least one of said control pressures.

5. A hydraulic system as claimed in claim 1 wherein the hydraulic system is on a lift truck having a telescopic upright, said first and second motor means and said selector and shuttle valve means are supported from a load support carriage movable vertically in the upright, said operator valve means being located at the operator's station on the lift truck, and two hydraulic conduits only reeved on the upright for vertical movement therewith between connections on the lift carriage and said operator valve means.

6. A hydraulic system as claimed in claim 1 wherein the hydraulic system is on a lift truck having a telescopic upright, said first and second motor means and said selector valve means being supported from a load support carriage movable vertically in the upright, said operator and shuttle valve means being located at the operator's station on the lift truck, and as few as two hydraulic conduits but no more than three thereof reeved on the upright for vertical movement therewith between connections on the lift carriage and said shuttle valve means.

7. A hydraulic system as claimed in claim 1 wherein said operator valve means comprises a single directional valve control and a valve to establish said first and second control pressures including a check valve downstream of the directional control valve.

8. In a hydraulic system, first and second hydraulic motor means, selector valve means movable to first and second positions in response to first and second respective control pressures present in the low pressure side of the system for operatively connecting said valve means in said first position to said first hydraulic motor means and in said second position to said second hydraulic motor means, operator valve means including a direction selector valve for reversing the first and second motor means and a pressure control valve for selecting the pressure level operative in the low pressure side of the system to actuate said selector valve means to said first or second position, a shuttle valve responsive to the high pressure side of the system in any operative position of said direction selector and pressure control valves, and a pilot pressure conduit connecting the low pressure side of the system to said selector valve means through said shuttle valve.

9. In a hydraulic system, first and second hydraulic motor means, selector valve means movable to first and second positions in response to first and second respective control pressures present in the low pressure side of the system for operatively connecting said valve means in said first position to said first hydraulic motor means and in said second position to said second hydraulic motor means, a directional control valve controlling the direction of operation of the first and second motor means and a control pressure selector valve for selection by the operator of the first and second control pressures, said selector valve means and first and second motor being supported from a carriage movable vertically on an upright of a lift truck, or the like, and two hydraulic conduits reeved on the upright connecting the directional control valve to the selector valve means, a shuttle valve connected between said hydraulic conduits and responsive to the pressure in the conduit carrying the highest pressure fluid for communicating to said selector valve means the lower pressure fluid in the other conduit in which is established said first or second control pressure by said control pressure selector valve.

10. A hydraulic system as claimed in claim 9 wherein said shuttle valves actuates towards the low pressure conduit to direct control pressure to said selector valve means which then connects the selected motor means to said high and low pressure conduits for operation in the direction selected by said directional control valve.

11. In a hydraulic system, first and second hydraulic motor means, selector valve means movable to first and second positions in response to first and second respective control pressures present in the low pressure side of the system for operatively connecting said valve means in said first position to said first hydraulic motor means and in said second position to said second hydraulic motor means, a directional control valve controlling the direction of operation of the first and second motor means and a control pressure selector valve for selection by the operator of the first and second control pressures, said control pressure selector valve being located downstream of said directional control valve.

12. In a hydraulic system, first, second and third hydraulic motor means, selector valve means movable to first, second and third positions in response to first, second and third respective control pressures present in the low pressure side of the system for operatively connecting said valve means in said first position to said first motor means, in said second position to said second motor means, and in said third position to said third motor means, operator valve means adapted to select the operation of said first, second or third motor means and to establish said first, second or third control pressures, two conduits connected from said operator valve means to said selector valve means, and shuttle valve means operatively connected between said conduits responsive to the high pressure fluid conduit for conducting control pressure from the low pressure fluid conduit to said selector valve means.

13. A hydraulic system is claimed in claim 12 wherein the hydraulic system is mounted on a lift truck having a telescopic upright and carriage means elevatable thereon, said two hydraulic conduits being reeved on the upright and comprising the only conduits for connecting the operator valve means at the operator's station to the lift carriage.

14. A hydraulic system as claimed in claim 12 wherein said operator valve means comprises a single directional control valve and a valve downstream of the directional control valve to establish said first, second and third control pressures including a pair of check valves.

* * * * *